US006116032A

United States Patent [19]

Mori et al.

[11] Patent Number: 6,116,032

[45] Date of Patent: Sep. 12, 2000

[54] METHOD FOR REDUCING PARTICULATE GENERATION FROM REGENERATION OF CRYOGENIC VACUUM PUMPS

[75] Inventors: Glen T. Mori, Pacifica; Daniel O. Clawson, Mountain View, both of Calif.

[73] Assignee: Applied Materials, Inc., Santa Clara, Calif.

[21] Appl. No.: 09/229,143

[22] Filed: Jan. 12, 1999

[51] Int. Cl.[7] ..... B01D 8/00

[52] U.S. Cl. ..... 62/55.5

[58] Field of Search ..... 62/55.5; 417/901

[56] References Cited

U.S. PATENT DOCUMENTS

| | | | |
|---|---|---|---|
| 4,485,631 | 12/1984 | Winkler | 62/55.5 |
| 4,614,093 | 9/1986 | Bachler et al. | 62/55.5 |
| 5,111,667 | 5/1992 | Hafner et al. | 62/55.5 |
| 5,157,928 | 10/1992 | Gaudet et al. | 62/55.5 |
| 5,259,735 | 11/1993 | Takahashi et al. | 417/203 |
| 5,375,424 | 12/1994 | Bartlett et al. | 62/55.5 |
| 5,400,604 | 3/1995 | Hafner et al. | 62/55.5 |
| 5,513,499 | 5/1996 | deRijke | 62/55.5 |
| 5,517,823 | 5/1996 | Andeen et al. | 62/55.5 |
| 5,819,545 | 10/1998 | Eacobacci et al. | 62/55.5 |

*Primary Examiner*—William Doerrler

*Attorney, Agent, or Firm*—Thomason, Moser & Patterson, LLP

[57] ABSTRACT

A method for reducing particulate generation from regeneration of cryogenic vacuum pumps. The method comprises controlling a pressure ramp rate inside the cryopump during an initial introduction of a regeneration gas into the cryopump. Preferably, the pressure ramp rate is controlled by maintaining a first pressure ramp rate, preferably between about 0.03 T/s and 0.15 T/s, until a first pressure of about 0.3 T is reached inside the cryopump and maintaining a second pressure ramp rate between about 1 T/s and 5 T/s until the surface in the cryopump reaches an intermediate temperature between about 40 K and 100 K. Preferably, the temperature ramp rate is also controlled by heating the surface at a temperature ramp rate between about 0.1 K/s and about 0.5 K/s until the intermediate temperature has been reached. Preferably, the temperature ramp rate is controlled by regulating the flow of an inert gas into the cryopump using a flow restriction device. Alternatively, the second stage cryoarray temperature is increased at the rate of between 0.1 K/s and 0.5 K/s using a PID controlled heater.

20 Claims, 3 Drawing Sheets

METHOD FOR REDUCING PARTICULATE GENERATION FROM REGENERATION OF CRYOGENIC VACUUM PUMPS

BACKGROUND OF THE INVENTION

1. Field of the Invention

The invention generally relates to regeneration of cryogenic vacuum pumps. More particularly, the invention relates to a method for reducing particulate generation from regeneration of cryogenic vacuum pumps.

2. Background of the Related Art

Cryogenic vacuum pumps (cryopumps) are widely used in high vacuum applications. Cryopumps are based on the principle of removing gases from a vacuum chamber by binding the gases on cold surfaces inside the cryopump. Cryocondensation and cryosorption are the main mechanisms involved in the operation of the cryopump. In cryocondensation, gas molecules are condensed on previously condensed gas molecules, and thick layers of condensation can be formed, thereby, pumping large quantities of gas. Cryosorption is commonly used to pump gases that are difficult to condense at the normal operating temperatures of the cryopump. In this case, a sorbent material, such as activated charcoal, is attached to the coldest surface in the cryopump, typically a second stage of a cryoarray. Because the binding energy between a gas particle and the adsorbing surface is greater than the binding energy between the gas particles themselves, the gas particles that cannot be condensed are removed from the vacuum system by adhering to the sorbent material. However, the effect of the adsorbing surface diminishes as the gas particles are adsorbed by the adsorbing surface of the sorbent material. After several monolayers of adsorbed gas particles have built up over the adsorbing surface, the adsorbing surface stops adsorbing the gas particles by cryosorption unless the adsorbing surfaces are regenerated or restored to a fresh, operable state.

Cryopumps typically include two stages of cryoarrays. A two-stage cryopump includes a first stage cryoarray, which typically operates at temperatures between about 50 K and about 100 K, and a second stage cryoarray, which typically operates at temperatures between about 10 K and about 20 K. The two-stage cryopump is typically matched to a closed-loop helium refrigerator that includes a two-stage expander which creates cryogenic refrigeration by the controlled expansion of compressed helium. Each stage of the cryoarrays is thermally connected to and independently cooled by one matching stage of the expander.

Different gases are pumped on different cryoarray surfaces within the cryopump. The first stage cryoarray typically pumps gases, such as water vapor and carbon dioxide, at relatively high temperatures by cryocondensation. An outer surface of the second stage cryoarray typically pumps gases, such as nitrogen, oxygen and argon, at the normal operating temperature of the second stage. An inner surface of the second stage cryoarray is typically coated with a sorbent material that pumps the noncondensable gases, such as hydrogen, neon and helium, by cryosorption. The sorbent material typically comprises charcoal and is bonded, glued or otherwise attached to the second stage cryoarray.

Under normal operating pressures, conditions of molecular flow exist in the cryopump. Practically all molecules entering the pump will strike the first stage cryoarray and the outer surface of the second stage cryoarray before reaching the sorbent material on the inner surface of the second stage cryoarray. Thus, all gases except the noncondensable gases, such as hydrogen, neon and helium, are pumped by cryocondensation before reaching the sorbent material, leaving the inner surface of the second stage free to pump the noncondensable gases by cryosorption.

Finite amounts of gas can be accumulated on the pump surfaces before performance deteriorates and eventually becomes unacceptable. Particularly for the second stage cryoarray, when several monolayers of adsorbed gas have been built up, the sorbent material loses its adsorption abilities, and the noncondensable gases can no longer be pumped by cryosorption on the sorbent material. At this point, captured gases on the cryoarrays need to be released and expelled from the cryopump, thereby renewing the pumping surfaces for further service. This process, called regeneration, includes heating the cryopump until the captured gases evaporate. The released gases are then removed from the cryopump through a pressure relief valve and/or are removed by a roughing pump that is attached to the cryopump. The cryopump is then cooled to its operating temperature, and normal cryopump operation is resumed.

A standard method for removing all captured gases, including condensed water vapor, heats the cryopump to a regeneration temperature while purging the cryopump with a regeneration or purge gas, typically an inert gas. The cryopump is typically purged for some time after reaching regeneration temperature, typically the same as the temperature of the regeneration gas, and is pumped with a roughing pump to remove the gases in the cryopump. Since all captured gases are removed from the cryopump, including both the first and second stage cryoarrays, this process is called full regeneration. Full regeneration typically requires several hours to complete. During this time, the cryopump and the equipment to which it is attached are inoperable, resulting in costly downtime for the system.

To shorten regeneration time, a process called partial regeneration or fast regeneration has been developed. In partial regeneration, only the gases pumped by the second stage cryoarray are removed from the cryopump. Typically, the second stage cryoarray is heated to a temperature between about 110 K and about 160 K, preferably about 125 K, by flowing a regeneration gas, typically an inert gas such as dry nitrogen, into the cryopump and/or by activating a heater that is thermally attached to the second stage cryoarray. However, the refrigerator continues to cool the first stage cryoarray to prevent release of gases from the first stage cryoarray. The released gases from the second stage cryoarray are removed using a roughing pump that is attached to the cryopump. Because only the second stage cryoarray is heated and regenerated, the time required for cryopump regeneration is decreased significantly.

A particular problem encountered in both full regeneration and partial regeneration of the cryopump is that the cryopump experiences thermal and mechanical shock at the beginning of the regeneration cycle caused by introducing the regeneration gas into the cryopump and heating the cryoarrays. More specifically, the cryopump experiences a pressure burst at the beginning of the regeneration cycle because of the initial introduction of the regeneration gas into the cryopump and the release of the gases from the cryoarrays. The pressure burst is typically caused by the uncontrolled introduction of a purge or regeneration gas at a high pressure (typically at about 80 PSI) into the cryopump, and the pressure burst has been observed on a strip chart recorder as a fast, nearly instantaneous pressure increase in the cryopump. The pressure burst causes fracturing of the cryoarray material and particulate generation from broken pieces of the cryoarray material, such as flaking and shedding of the charcoal. The particulates dislodged from the cryoarray material lead to contamination of the vacuum processing chamber, and the contamination of the vacuum processing chamber causes defect formations on substrates subsequently processed in the chamber. The sudden increase in temperature of the cryoarrays also contributes to fractures of the cryoarray material and particulate generation from broken pieces of the cryoarray material, which leads to contamination of the vacuum processing chamber and defect formations on substrates subsequently processed in the chamber.

Therefore, there is a need for a method of regenerating a cryogenic vacuum pump that significantly reduces the particulate generation from the cryoarray material caused by the thermal and mechanical shock experienced by the cryopump during regeneration. Particularly, there is a need for a regeneration method that significantly reduces or eliminates the pressure burst that occurs at the beginning of the regeneration cycle. Also, there is a need to control the temperature ramp rate of the cryoarrays to reduce thermally induced stress on the cryoarrays during the regeneration cycle.

SUMMARY OF THE INVENTION

The invention generally provides a method of regenerating a cryogenic vacuum pump that significantly reduces the particulate generation from the cryoarray material caused by the thermal and mechanical shock experienced by the cryopump during regeneration. Particularly, the invention provides a regeneration method that significantly reduces or eliminates the pressure burst that occurs at the beginning of the regeneration cycle. Also, the invention controls the temperature ramp rate of the cryoarrays to reduce thermally induced stress on the cryoarrays during the regeneration cycle. The invention significantly reduces the fracturing and particulate generation from the cryoarray material. The invention also significantly reduces the contamination of the vacuum processing chamber and the defects formed on substrates subsequently processed in the chamber due to the cryopump regeneration process.

One aspect of the invention provides a method for regenerating a surface in a cryopump comprising controlling a pressure ramp rate inside the cryopump during an initial introduction of a regeneration gas into the cryopump and flowing the regeneration gas into the cryopump until the surface reaches a regeneration temperature. Preferably, the pressure ramp rate is controlled by adjusting the flow of the regeneration gas into the cryopump using a flow restriction device. The pressure ramp rate is preferably controlled by maintaining a first pressure ramp rate between about 0.03 T/s and about 0.15 T/s until a pressure of at least about 0.3 T is reached inside the cryopump and maintaining a second pressure ramp rate between about 1 T/s and about 5 T/s until the surface in the cryopump reaches an intermediate temperature between about 40 K and about 100 K. Preferably, the temperature ramp rate of the cryopump surface to be regenerated is correspondingly controlled by heating the surface at a temperature ramp rate between about 0.1 K/s and about 0.5 K/s until the intermediate temperature has been reached. Preferably, the temperature ramp rate is controlled by regulating the flow of an inert gas into the cryopump using a flow restriction device. Alternatively, the temperature is increased at the rate of between 0.1 K/s and 0.5 K/s using a PID controlled heater that is thermally attached to the surface of the cryopump to be regenerated. The released gases are exhausted from the cryopump by activating a roughing pump attached to the cryopump, and the cryopump is cooled to resume normal cryopump operation.

Another aspect of the invention provides a "soft start" to conventional regeneration methods. By providing a "soft start" for the regeneration of the cryopump, the invention significantly reduces the thermal and mechanical shock experienced by the cryopump during regeneration and the particulate generation from the cryoarray material. The "soft "start" (i.e., initiation of the regeneration process) according to the invention comprises controlling a pressure ramp rate inside the cryopump during an initial introduction of a regeneration gas into the cryopump. Preferably, the pressure ramp rate is controlled by maintaining a first pressure ramp rate, preferably between about 0.03 T/s and 0.15 T/s, until a first pressure of about 0.3 T is reached inside the cryopump and maintaining a second pressure ramp rate between about 1 T/s and 5 T/s until the surface in the cryopump reaches an intermediate temperature between about 40 K and 100 K. Preferably, the temperature ramp rate is also controlled by heating the surface at a temperature ramp rate between about 0.1 K/s and about 0.5 K/s until the intermediate temperature has been reached. After the intermediate temperature has been reached, the cryopump regeneration is continued and finished employing conventional regeneration methods, including partial regeneration, full regeneration, and sub-atmospheric regeneration.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
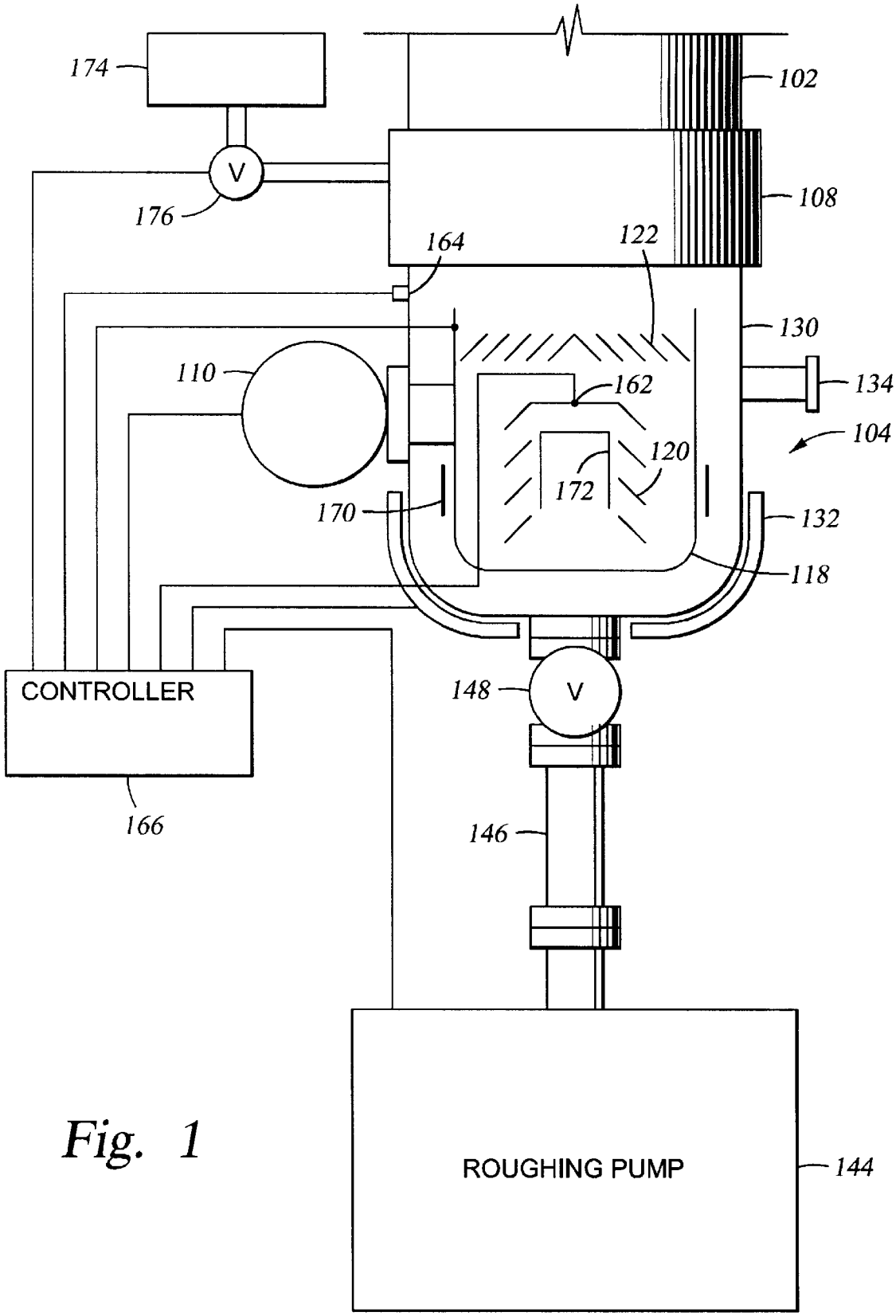
FIG. 1 is a simplified cross sectional schematic view of a vacuum pumping apparatus according to the invention.

FIG. 1 is a simplified cross sectional schematic view of a vacuum pumping apparatus according to the invention. The vacuum pumping apparatus 100 is attached to a vacuum processing chamber 102 (partially shown) and typically includes a cryogenic vacuum pump (cryopump) 104 and a mechanical vacuum pump 106. The vacuum processing chamber 102 is capable of maintaining a high vacuum and is typically used for performing vacuum processing of a substrate, particularly semiconductor substrates. The mechanical vacuum pump 106 typically comprises a roughing pump, a turbomolecular pump, a combination of a roughing pump and a turbomolecular pump, or other mechanical vacuum pumps. The cryopump 104 preferably comprises a standard, commercially available cryopump, such as a two-stage cryopump. Typically, the cryopump 104 is attached to the vacuum processing chamber 102, and the mechanical vacuum pump 106 is attached to the cryopump 104. Preferably, the mechanical vacuum pump 106 comprises a roughing pump 144 connected through a roughing conduit 146 and a roughing valve 148 to the cryopump 104. Suitable mechanical pumps are well known in the art and are commercially available.

The cryopump 104 includes an inlet attached to the vacuum processing chamber 102 through a high vacuum valve 108. The cryopump 104 includes a refrigerator 110, typically a closed-loop helium refrigerator having a first and second expander in thermal contact with a first stage cryoarray 118 and a second stage cryoarray 120, respectively. The refrigerator 110 provides independent cooling of the first and second stage cryoarrays. The first stage cryoarray 118 typically includes a baffle 122 which shields the second stage cryoarray 120 from the vacuum processing chamber 102. The second stage cryoarray 120 preferably includes a sorbent material, such as activated charcoal, on its inside surface for pumping of noncondensable gases by cryosorption.

The cryopump 104 includes a housing 130 which encloses the first stage cryoarray 118 and the second stage cryoarray 120, except for the opening to vacuum chamber 102. A housing heater 132 disposed externally to the vacuum region of cryopump 104 surrounds at least a portion of the housing 130 and is in thermal contact with housing 130. The housing heater 132 can, for example, be a standard band heater and is typically used during partial regeneration. A pressure relief valve 134 is mounted on the cryopump 104, typically on the housing 130. Preferably, the pressure relief valve 134 automatically opens when the pressure within the cryopump 104 reaches a predetermined value, such as atmospheric pressure.

Figure 2:
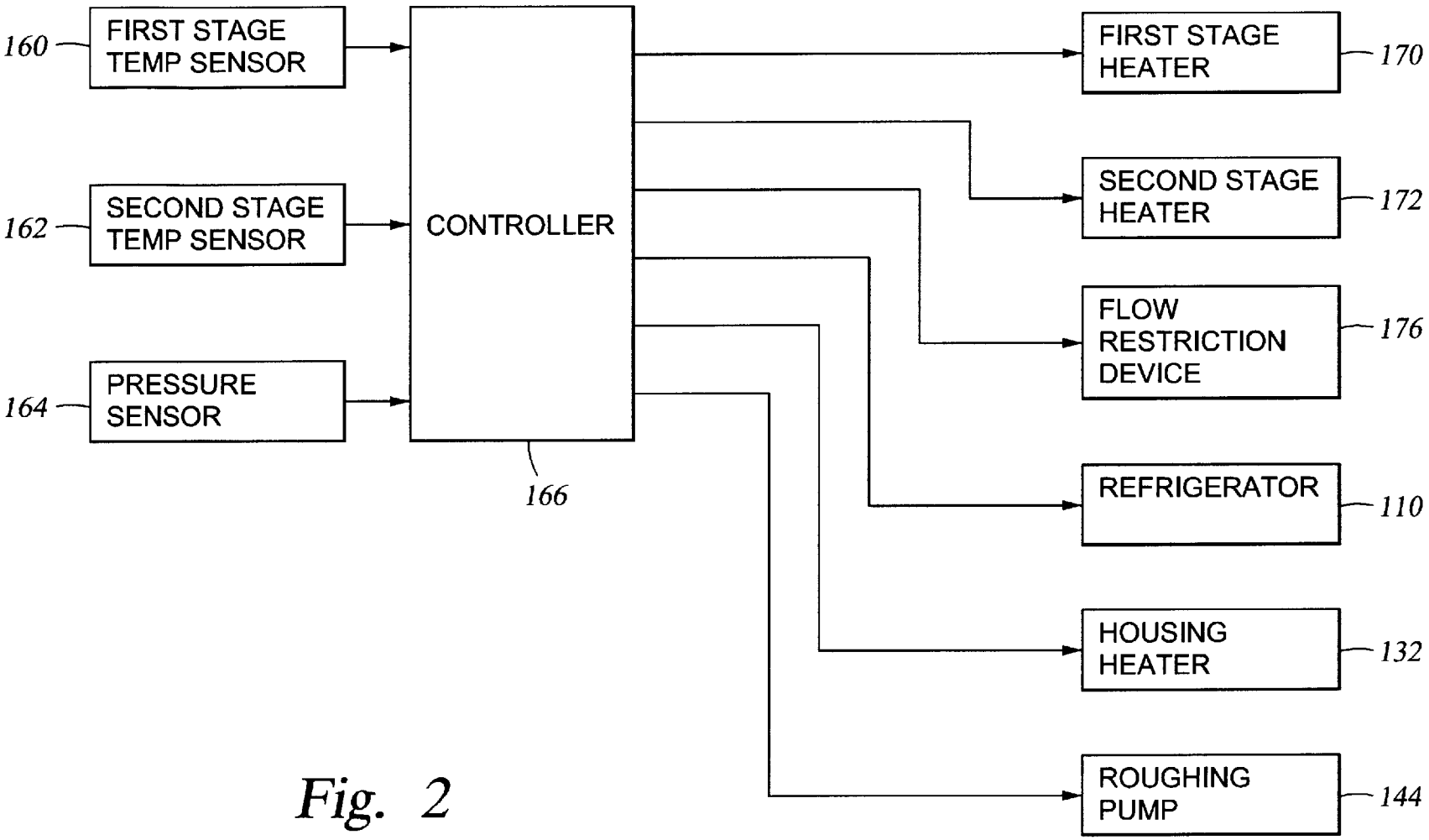
FIG. 2 is a schematic diagram of a control system for the vacuum pumping apparatus 100.

The vacuum pumping apparatus 100 also includes a controller 166 for controlling the normal operations of the cryopump, including the regeneration cycles. FIG. 2 is a schematic diagram of a control system for the vacuum pumping apparatus 100. Referring to both FIGS. 1 and 2, a first stage temperature sensor 160, a second stage temperature sensor 162 and a pressure sensor 164 supply input signals to a controller 166. The first and second stage temperature sensors 160 and 162 sense the temperature of the first and second stage cryoarrays 118 and 120, respectively. The pressure sensor 164 senses the pressure level within the cryopump 104. The first stage temperature sensor 160, the second stage temperature sensor 162 and the pressure sensor 164 are preferably disposed in or on the cryopump 104 to accurately measure the temperatures and pressure, respectively. As shown in FIG. 1, the temperature sensors 160, 162 are disposed on the cryoarrays 118, 120, respectively, and the pressure sensor 162 is disposed on the cryopump housing 130.

The controller 166 is preferably implemented using a microprocessor and supplies control signals for energizing and de-energizing the refrigerator 110, the housing heater 132 and the roughing pump 144. In addition, the controller 166 provides control signals for energizing and de-energizing a first stage heater 170, which is in thermal contact with the first stage cryoarray 118, and a second stage heater 172, which is in thermal contact with the second stage cryoarray 120. Finally, the controller 166 controls the flow of a regeneration gas into the cryopump during regeneration by adjusting a flow restriction device 176, such as an adjustable valve and a mass flow controller. The regeneration gas source 174, preferably a nitrogen source, is connected to the cryopump 104 through a flow restriction device 176 that controls the flow of the regeneration gas into the cryopump 104 during regeneration as described below.

The controller 166 preferably controls the overall operation of the vacuum pumping apparatus 100, including a normal operating cycle and a regeneration cycle. During the normal operating cycle, the cryopump 104 pumps or removes gases from vacuum processing chamber 102 by cryocondensation and cryosorption. The regeneration cycle is used to remove captured gases from the cryopump 104 and may be initiated manually or automatically at predetermined intervals. The regeneration cycle can be either a full regeneration or a partial regeneration.

During the normal operating cycle, the first stage cryoarray 118 typically operates at temperatures between about 50 K and about 100 K and pumps gases such as water vapor and carbon dioxide. The second stage cryoarray 120 typically operates at temperatures between 10 K and 20 K. The top outside surface of the second stage cryoarray 120 pumps gases such as nitrogen, oxygen and argon. The sorbent material on the inside surface of the second stage cryoarray 120 pumps noncondensable gases such as hydrogen, neon and helium by cryosorption. After operation of the cryopump 104 for some time, large amounts of the above gases are captured on the pump surfaces, and regeneration is required to renew pump operation. Either a full regeneration or a partial regeneration is performed to restore the pumping capabilities of the cryopump.

According to the invention, the cryopump regeneration process is performed through a "soft start" that significantly reduces the thermal and mechanical shock experienced by the cryopump during the initial heating of the cryopump for regeneration. The inventors have discovered that the thermal and mechanical shock experienced by the cryopump is significantly reduced by controlling the flow of the regeneration gas into the cryopump and the corresponding pressure ramp rate (i.e., the rate of increase in pressure over time) inside the cryopump and by controlling the temperature ramp rate (i.e., the change or increase in temperature over time) of the cryoarrays during the initial stage of the regeneration cycle.

Preferably, an initial introduction of the regeneration gas to heat the cryoarray to a regeneration temperature is controlled by the flow restriction device to achieve a "soft start" of the regeneration cycle. During the initial introduction of the regeneration gas into the chamber, the flow rate of the regeneration gas is preferably controlled to provide a pressure ramp rate inside the cryopump at less than about 0.15 T/s, even more preferably at less than about 0.03 T/s. The pressure inside the cryopump is continuously monitored by the pressure sensor 164, and the controller 166 correspondingly adjusts the flow restriction device 176 to control the flow of the regeneration gas into the cryopump. The pressure ramp rate is preferably controlled at less than 0.03 T/s until the pressure inside the cryopump reaches between about at least about 0.3 T and about 1 T. After the pressure inside the cryopump reaches 0.3 T, the flow rate of the regeneration gas is adjusted to maintain a pressure ramp rate between about 1 T/s and about 5 T/s until the temperature of the cryoarray being regenerated reaches an intermediate temperature that is lower than the regeneration temperature. Preferably, the intermediate temperature is between about 40 K and about 100 K, and even more preferably at about 80 K. The intermediate temperature is selected according to the total time allowed for the regeneration process. Since the cryoarray is heated by the regeneration gas, the temperature ramp rate is directly affected by adjusting the flow of the regeneration gas. Preferably, the flow rate of the regeneration gas is adjusted to provide a corresponding temperature ramp rate of the cryoarray between about 0.1 K/s and about 0.5 K/s, even more preferably between about 0.25 K/s and about 0.35 K/s. Alternatively, the temperature ramp rate is also controlled by the heater that is thermally attached to the cryoarray, such as a proportional-integral-derivative (PID) controlled heater.

After the "soft start" according to the invention, the regeneration cycle is carried out using typical regeneration methods. For example, to continue a partial regeneration process after the "soft start," the regeneration gas is then flowed into the cryopump with the flow restriction device 176 at a fully open position until the temperature of the second stage cryoarray reaches a pre-selected partial regeneration temperature. The partial regeneration temperature range is typically selected to liberate captured gas from the second stage cryoarray 120 while retaining condensed water vapor on the first stage cryoarray 118. The partial regeneration temperature range is preferably in a range of 100 K to 160 K, more preferably in a range of 120 K to 140 K, and even more preferably at about 125 K. After the cryoarray temperature reaches the partial regeneration temperature, the flow of the regeneration gas into the cryopump is terminated, and the partial regeneration temperature of the second stage cryoarray is preferably maintained for less than about 1 minute. The released gases are exhausted through the roughing pump 144, and the second stage cryoarray is cooled down to its operating temperature again to resume normal cryopump operation.

As a second example, to continue a full regeneration process after the "soft start," the regeneration gas is flowed into the cryopump with the flow restriction device 176 at a fully open position until the temperature of the cryopump reaches a pre-selected full regeneration temperature, preferably at about room temperature or at about the temperature of the regeneration gas. The flow of the regeneration gas is then terminated, and the released gases are exhausted through the roughing pump 144. The cryopump is then cooled down to resume normal cryopump operation. The roughing pump 144 may also be activated throughout the partial regeneration process, and excess pressure inside the cryopump during regeneration may be relieved through the pressure relief valve 134.

Alternatively, the invention provides a "soft start" to the regeneration cycle by controlling the temperature ramp rate of the cryoarray. The temperature ramp rate is preferably maintained between about 0.1 K/s and about 0.5 K/s, even more preferably between about 0.25 K/s and about 0.35 K/s, and controlled by adjusting the flow rate of the regeneration gas into the chamber. The temperature of the cryoarray is monitored by the temperature sensors 160,162 and provided to the controller 166, and the controller 166 adjusts the flow restriction device 176 to decrease or increase the flow of the regeneration gas according to the temperature increase of the cryoarray to maintain the desired temperature ramp rate. Preferably, the controller 166 continuously monitors and controls the temperature of the cryoarrays by continuously adjusting the flow restriction device according to the temperature ramp rate.

Alternatively, the temperature ramp rate of the cryoarrays during the regeneration cycle is controlled by the heaters that are thermally attached to the cryoarrays. Typically, these heaters are switched between an activated (ON) state during the regeneration cycle and a deactivated (OFF) state during normal operation cycle of the cryopump. The typical activation of the heaters causes thermal shock to the cryoarrays because of the sudden increase in temperature as the heaters are turned on or activated. Typically, the temperature of the cryoarrays increases to about 55 K within 60 seconds of activating the heaters. The invention provides a graduated activation of the heaters to achieve the desired temperature ramp rate of the cryoarrays. Preferably, the temperature of the cryoarrays are controlled using a proportional-integral-derivative (PID) temperature controller. According to the invention, the controller 166 increases the temperature of the cryoarrays at a temperature ramp rate of between about 0.1 K/s and about 0.5 K/s, preferably between about 0.25 K/s and about 0.35 K/s, until the second stage cryoarray reaches 80 K. Alternatively, when a cryoarray is heated by a resistive heater that is activated by a voltage applied across the heater, the controller gradually increases the voltage applied across the heater from zero volts (OFF state) to the typical operating voltage of the resistive heater. Preferably, the controller 166 continuously monitors the temperature of the cryoarrays using the temperature sensors 160,162 and increases or decreases the voltage applied across the resistive heater to achieve the desired temperature ramp rate of the cryoarray.

After the "soft start" of the regeneration process according to the invention, the regeneration of the cryopump can be continued and finished using conventional regeneration methods well known in the art. Examples of conventional cryopump regeneration methods are described in U.S. Pat. No. 5,513,499, by deRijke, entitled "Method And Apparatus For Cryopump Regeneration Using Turbomolecular Pump," which is hereby incorporated by reference in its entirety, and U.S. Pat. No. 5,517,823, by Andeen et al., entitled "Pressure Controlled Cryopump Regeneration Method And System," which is also hereby incorporated by reference in its entirety. The "soft start" regeneration method according to the present invention can be implemented or incorporated in these as well as other conventional cryopump regeneration methods well known in the art, including full regeneration, partial regeneration, sub-atmospheric regeneration and other regeneration methods.

The "soft start" of the regeneration cycle according to the invention significantly reduces or eliminates the thermal and mechanical shock typically experienced by the cryopump during conventional cryopump regeneration methods. The invention significantly reduces the fracturing and particulate generation from the charcoal array that leads to contamination of the vacuum processing chamber, which may cause defects formed on substrates subsequently processed in the chamber. The invention significantly reduces or eliminates the pressure bursts experienced by the cryopump during the initial introduction of the regeneration gas at the beginning of the regeneration process. Preferably, the invention controls the pressure ramp rate inside the cryopump by adjusting the flow rate of the regeneration gas into the cryopump using a flow restriction device. The invention preferably also controls the temperature ramp rate of the cryoarrays during the initial stage of the regeneration cycle to reduce fracturing of the cryosorbent material or the cryoarray caused by the thermally induced stress.

EXAMPLE

Figure 3:
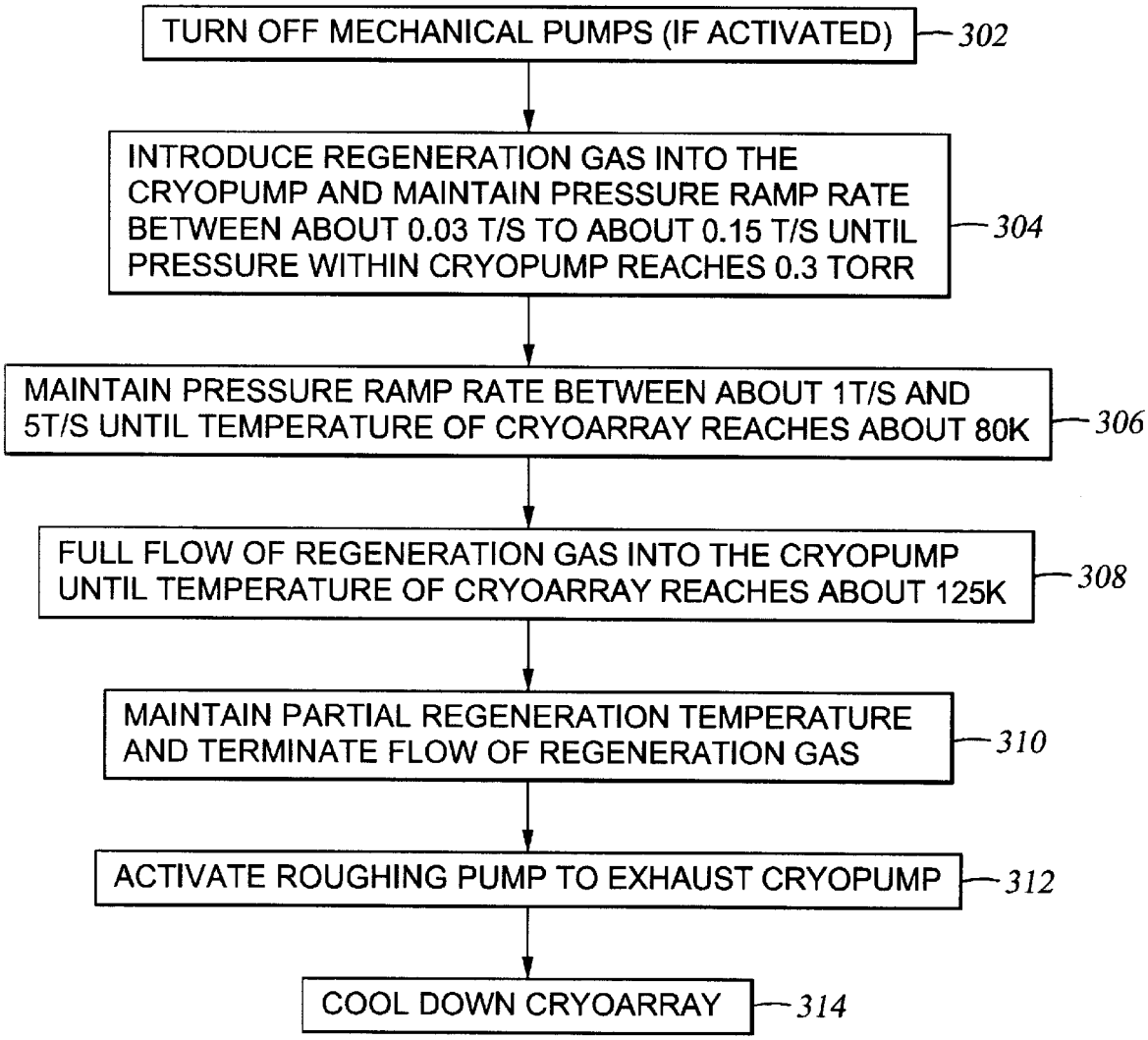
FIG. 3 is a flow chart of a partial regeneration cycle incorporating the "soft start" according to the present invention.

FIG. 3 is a flow chart of a partial regeneration cycle incorporating the "soft start" according to the present invention. As an initial step of the partial regeneration cycle, the roughing pump 144 is turned off (step 302), if it has been in operation during the normal operating cycle. Optionally, the housing heater 132 is activated during the partial regeneration cycle to prevent the housing 130 from reaching low temperatures during the partial regeneration cycle, and thereby prevents condensation of large amounts of water vapor on the outer surface of housing 130.

The partial regeneration cycle is then "soft started" (step 304 and step 306) according to the invention. The "soft start"

regeneration is preferably achieved by controlling the flow rate of the regeneration gas into the cryopump used for heating the second stage cryoarray 120. The "soft start" regeneration comprises controlling the pressure ramp rate inside the cryopump during the initial introduction of the regeneration gas into the cryopump. The regeneration gas, typically an inert gas such as nitrogen or argon, is flowed from the regeneration gas source 174 into the cryopump 104 and controlled by the flow restriction device 176 at a controlled rate to provide a controlled pressure ramp rate of about 0.03 T/s inside the cryopump until the pressure inside the cryopump reaches at least about 0.3 T (step 302). The pressure inside the cryopump is continuously monitored by the pressure sensor 164, and the controller 166 adjusts the flow restriction device 176 correspondingly to the pressure measurements received to increase or decrease the flow of the inert gas into the cryopump.

After the pressure inside the cryopump reaches about 0.3 T, the flow of the inert gas into the cryopump is adjusted to maintain a pressure ramp rate of between about 1 T/s and about 5 T/s until the temperature of the second stage cryoarray 120 reaches about 80 K (step 306). Preferably, the temperature of the second stage cryoarray 120 is controlled at a temperature ramp rate of between about 0.25 K/s and about 0.35 K/s. The temperature of the second stage cryoarray is monitored by the second stage temperature sensors, and the controller 166 adjusts the flow of the inert gas to maintain the temperature ramp rate of the second stage cryoarray within the desired range. Additionally, the temperature ramp rate of the second stage cryoarray can be controlled using a PID controlled heater that is thermally attached to the second stage cryoarray.

After the "soft start" of the regeneration process, the flow of the inert gas into the cryopump is increased, preferably to the maximum flow allowed by the flow restriction device 176, until the second stage cryoarray 120 reaches the partial regeneration temperature, typically between about 100 K and about 160 K, preferably about 125 K (step 308). When the temperature of the second stage cryoarray 120 reaches the partial regeneration temperature, the flow of the inert gas into the cryopump is terminated, and the temperature of the second stage cryoarray 120 is maintained at the partial regeneration temperature for about less than one minute (step 310). The roughing pump 144 is then activated (step 312) to exhaust the released gas from the cryopump 104. When the pressure within the cryopump 104 reaches a desired vacuum level, preferably between about 1 millitorr and about 50 millitorr, the refrigerator 110 is activated to cool the cryopump 104 to its normal operating temperatures (step 314). Once the cryoarrays are cooled to their normal operating temperatures, the partial regeneration cycle is completed, and the normal operation of the cryopump is resumed.

While foregoing is directed to the preferred embodiment of the present invention, other and further embodiments of the invention may be devised without departing from the basis scope thereof, and the scope thereof is determined by the claims that follow.

What is claimed is:

1. A method for regenerating a surface in a cryopump, comprising:

a) controlling an increasing pressure ramp rate inside the cryopump during an initial introduction of a regeneration gas into the cryopump; and b) flowing the regeneration gas into the cryopump until the surface reaches a regeneration temperature.

2. The method of claim 1 wherein the pressure ramp rate is controlled by adjusting the flow of the regeneration gas into the cryopump using a flow restriction device.

3. A method for regenerating a surface in a cryopump, comprising:

a) controlling a pressure ramp rate inside the cryopump during an initial introduction of a regeneration gas into the cryopump, comprising:

i) maintaining a first pressure ramp rate until a first pressure is reached inside the cryopump; and ii) maintaining a second pressure ramp rate until the surface in the cryopump reaches an intermediate temperature and b) flowing the regeneration gas into the cryopump until the surface reaches a regeneration temperature.

4. The method of claim 3 wherein the first pressure ramp rate is between about 0.03 T/s and about 0.15 T/s.

5. The method of claim 4 wherein the first pressure is at least about 0.3 T.

6. The method of claim 3 wherein the second pressure ramp rate is between about 1 T/s and about 5 T/s.

7. The method of claim 6 wherein the intermediate temperature is between about 40 K and about 100 K.

8. The method of claim 6 wherein the second pressure ramp rate is maintained to correspond to a temperature ramp rate of the surface between about 0.1 K/s and about 0.5 K/s until the surface reaches the intermediate temperature.

9. The method of claim 1, further comprising:

c) controlling a temperature ramp rate of the surface while controlling the pressure ramp rate.

10. The method of claim 1, further comprising:

c) exhausting gases in the cryopump using a mechanical pump; and d) cooling the surface to a cryopump operating temperature.

11. A method for initiating a regeneration process for a cryopump, comprising:

controlling an seconds pressure ramp rate inside the cryopump during an initial introduction of a regeneration gas into the cryopump.

12. The method of claim 11 wherein the pressure ramp rate is controlled by adjusting the flow of the regeneration gas into the cryopump using a flow restriction device.

13. A method for initiating a regeneration process for a cryopump, comprising:

a) controlling a pressure ramp rate inside the cryopump during an initial introduction of a regeneration gas into the cryopump, comprising:

i) maintaining a first pressure ramp rate until a first pressure is reached inside the cryopump; and ii) maintaining a second pressure ramp rate until the surface in the cryopump reaches an intermediate temperature.

14. The method of claim 13 wherein the first pressure ramp rate is between about 0.03 T/s and about 0.15 T/s and the first pressure is at least about 0.3 T.

15. The method of claim 13 wherein the second pressure ramp rate is between about 1 T/s and about 5 T/s and the intermediate temperature is between about 40 K and about 100 K.

16. The method of claim 11, further comprising:

b) controlling a temperature ramp rate of the surface while controlling the pressure ramp rate.

17. A method for regenerating a surface in a cryopump, comprising:

a) heating the surface at a temperature ramp rate between about 0.1 K/s and about 0.5 K/s to a first temperature; and b) heating the surface to a regeneration temperature.

18. The method of claim 1 wherein the first temperature is between about 40 K and about 100 K and the regeneration temperature is between about 100 K and about 160 K.

19. An apparatus for regenerating a cryopump, comprising:

a) a pressure sensor disposed in the cryopump;

b) a flow restriction device connected to a regeneration gas source; and c) a controller connected to receive pressure measurements from the pressure sensor and to control the flow restriction device; wherein the controller controls an increasing pressure ramp rate in the cryopump by adjusting a flow of the regeneration gas into the chamber.

20. The apparatus of claim 19, further comprising:

d) a temperature sensor disposed in the cryopump to provide temperature measurements to the controller; wherein the controller controls a temperature ramp rate of the cryopump.

* * * * *

UNITED STATES PATENT AND TRADEMARK OFFICE
CERTIFICATE OF CORRECTION

PATENT NO : 6,116,032

DATED : September 12, 2000

INVENTOR(S): Mori et al.

It is certified that error appears in the above-identified patent and that said Letters Patent are hereby corrected as shown below:

In column 10, line 35, please replace " seconds" with - increasing --.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*